US005595009A

United States Patent [19]

Rummer

[11] Patent Number: 5,595,009

[45] Date of Patent: Jan. 21, 1997

[54] GROUND-PENETRATING MARKER APPARATUS

[76] Inventor: Charles W. Rummer, 4025 Old Wheeling Rd., Zanesville, Ohio 43701

[21] Appl. No.: 297,166

[22] Filed: Aug. 29, 1994

[51] Int. Cl.[6] ..... G09F 15/00

[52] U.S. Cl. ..... 40/606; 40/611; 40/608

[58] Field of Search ..... 273/176 L, 32 H, 273/32 A, 32 B; 40/606, 645, 584, 611, 649; 248/156

[56] References Cited

U.S. PATENT DOCUMENTS

| | | | |
|---|---|---|---|
| 4,329,800 | 5/1982 | Shuman | 40/606 |
| 4,337,590 | 7/1982 | Jackson | 40/615 |
| 4,521,018 | 6/1985 | Cotchonis . | |
| 4,534,125 | 8/1985 | Buck | 40/645 |
| 4,832,338 | 5/1989 | Magazzi . | |
| 4,852,512 | 8/1989 | Klatt . | |
| 4,923,157 | 5/1990 | Belamiza . | |
| 5,050,828 | 9/1991 | Wolff | 248/156 |
| 5,158,179 | 10/1992 | Gosselin . | |
| 5,207,402 | 5/1993 | Berry-Tremmel et al. | 248/156 |

OTHER PUBLICATIONS

Davidson, Location Marker for golf balls Nov. 12, 1929, U.S. Patent No. 1735736; all.

*Primary Examiner*—V. Millin
*Assistant Examiner*—Charles W. Anderson

[57] ABSTRACT

A ground-penetrating marker apparatus includes a sign-supporting assembly which includes a frame-like receptacle portion adapted to receive an information-bearing card. A spike assembly is connected to a bottom portion of the sign-supporting assembly, and the spike assembly is adapted for penetration into a ground surface. A cover assembly is connected to a top portion of the sign-supporting assembly for protecting the receptacle portion of the sign-supporting assembly from rain. The sign-supporting assembly includes a floor portion, a back wall portion supported by the floor portion, a front wall portion supported by the floor portion, and two side wall portions connected between the back wall portion and the front wall portion, all of which together define the receptacle portion of the sign-supporting assembly. A holder assembly for a writing implement is connected to a rear portion of the sign-supporting assembly. The bottom portion of the sign-supporting assembly includes a threaded well, and the spike assembly includes a threaded upper end adapted to be screwed into the threaded well of the sign-supporting assembly. A hinge assembly connects the sign-supporting assembly with the cover assembly. The cover assembly includes an L-shaped cover member connected to the second portion of the hinge assembly. The L-shaped cover member includes a transparent panel portion which permits viewing an information-bearing card in position in the receptacle portion of the sign-supporting assembly.

2 Claims, 2 Drawing Sheets

FIG 1
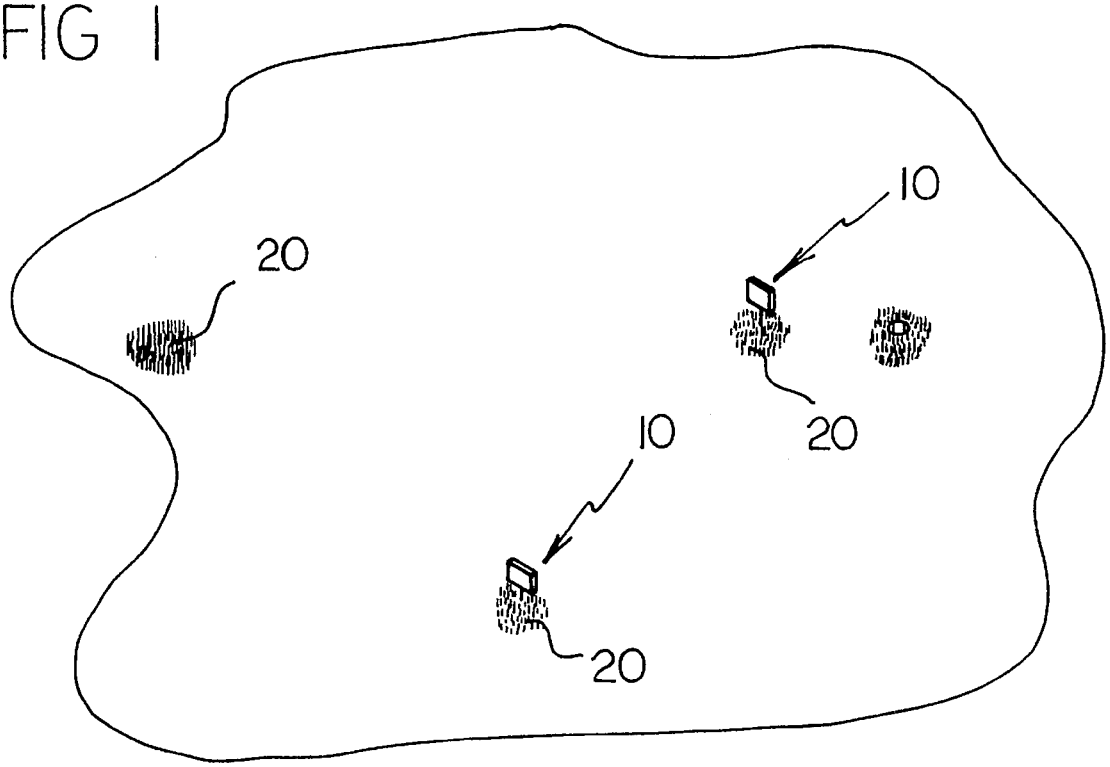
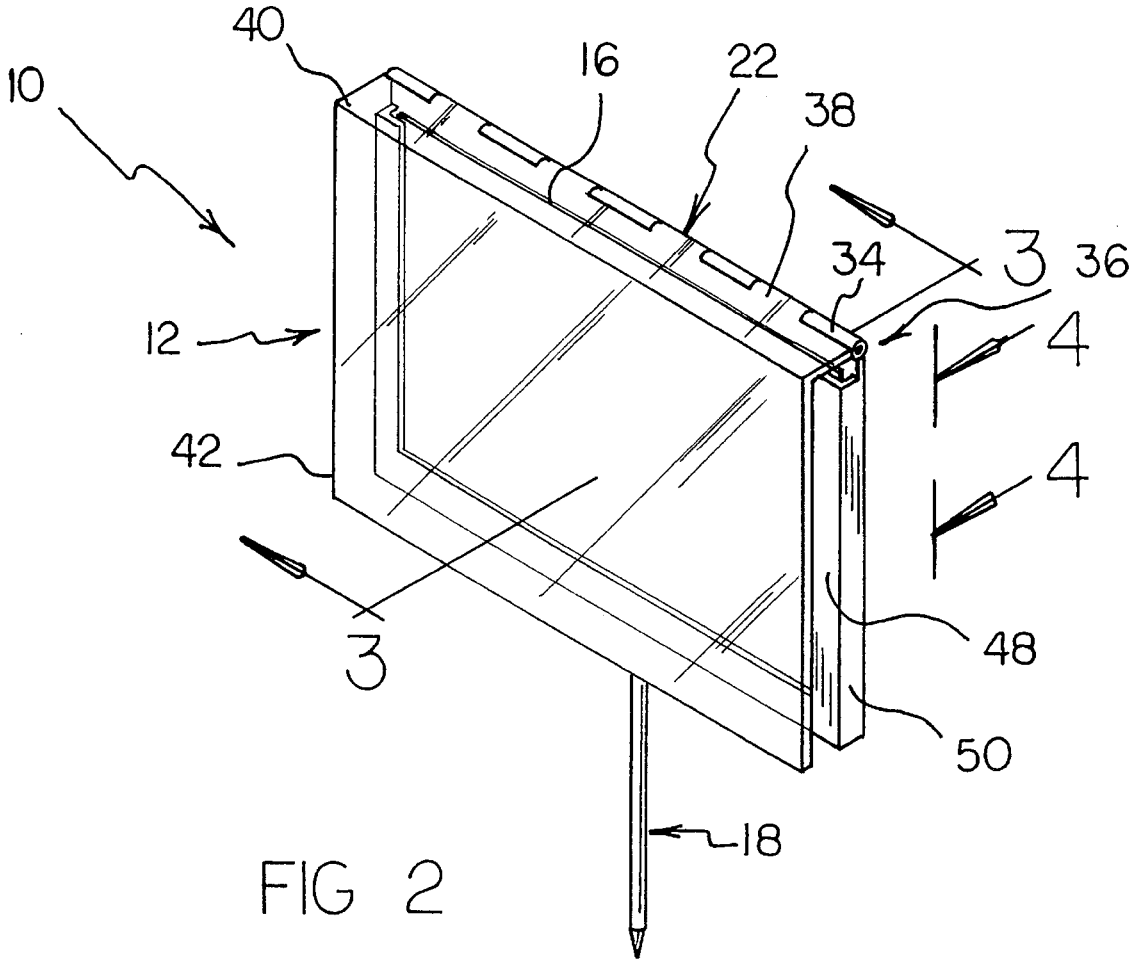
FIG 2

GROUND-PENETRATING MARKER APPARATUS

BACKGROUND OF THE INVENTION

1. Field of the Invention

The present invention relates generally to devices for displaying information and, more particularly, to information displaying devices that are especially adapted for being directly supported by the ground.

2. Description of the Prior Art

Throughout the years a number of types of devices have been invented for displaying information in an outdoor environment wherein the information display device is directly supported by the ground. For example, U.S. Pat. No. 4,521,018 discloses a device for marking the position of a golf ball on a golf course. This device includes a semicircular device that partially surrounds a golf ball without the device penetrating into the ground. Without having a ground-penetrating portion, this device is susceptible to being lifted off of the ground surface by a gust of wind. In this respect, it would be desirable if an information display device were provided for marking a golf ball on a course which included a ground-penetrating portion.

U.S. Pat. No. 4,832,338 discloses a multipurpose golf game utensil that includes two ground-penetrating portions and includes components designed for serving as a stand for a golf club. Two off-set horizontal rods are covered with frictional material to aid in the support of a golf club. A horizontal bar is also provided for scraping the surface of a club to remove dirt from the club. Although this device has a number of useful purposes, it does not serve as a marker for a golf ball. Moreover, to create sufficient stability for supporting a golf club, this device has two spike members. Therefore, two holes must be made in the golf course each time this device is used. Moreover, because two spikes are present, placement and removal of the two spikes in the ground require either a directly vertical or rocking direction of inserting or removing force. A rocking motion, especially, may do considerable damage to a golf course surface. Less damage would result if a spinning motion could be employed with a ground-penetrating spike. However, one cannot simply spin this device around on a ground-penetrating spike for insertion and removal of the spike from the ground.

U.S. Pat. No. 4,852,512 discloses a location marking stake that includes a hollow ground-penetrating portion and an information-bearing portion that is comprised of a roll of a narrow strip of sheet metal that is housed in the hollow ground-penetrating portion and removed therefrom by grasping a pulling a free end of the narrow strip. Because the ground-penetrating portion must house the rolled up strip, it must be relatively large in diameter. As a consequence, when penetrating the ground, it must displace a considerable volume of soil and may do considerable damage to the soil. In this respect, it would be desirable if an information display device were provided which did not include a hollow ground-penetrating housing.

U.S. Pat. No. 4,923,157 discloses a signpost support bracket that includes L-shaped ground brackets that receive separate and distinct ground-penetrating spikes that are driven into the ground. Two spikes are used, one for each of two legs of the sign. As stated above, two ground-penetrating spikes do not permit a spinning action to be employed with a spike. Moreover, with the use of separate and distinct spikes, there is always the possibility that the spikes can be separated from the sign when the sign is in storage, and the spikes can be lost or misplaced. In this respect, it would be desirable if an information display device were provided which included a ground-penetrating spike that is integrated into the structure of the information display device.

U.S. Pat. No. 5,158,179 may be of interest for its disclosure of a combination identification tag and holding apparatus for golf tees. The identification tag portion includes advertising indicia and a transparent cover.

Still other features would be desirable in a ground-penetrating marker apparatus. For example, it would be desirable for a ground-penetrating marker apparatus to be adapted to readily receive a separate and distinct card upon which identifying indicia or information can be written. Furthermore, it would be desirable for a ground-penetrating marker apparatus to provide protection for the information-bearing card against rain. Often, during the course of a golf game, one may desire to record specific information on a sheet of paper or the like. To do so, one needs a writing implement, such as a pencil. Often, however, one forgets to carry a writing implement, and must do without. To overcome this problem, it would be desirable if a ground-penetrating marker apparatus were provided with a holder for a writing implement so that a writing implement is readily available.

Thus, while the foregoing body of prior art indicates it to be well known to use ground-penetrating marker devices, the prior art described above does not teach or suggest a ground-penetrating marker apparatus which has the following combination of desirable features: (1) provides an information display device for marking a golf ball on a course which includes a ground-penetrating portion; (2) does not require making two holes in the ground each time the ground-penetrating marker apparatus is used; (3) does not require a rocking motion for inserting or removing the apparatus from the ground; (4) permits use of a spinning motion to be employed with a ground-penetrating spike for inserting or removing the spike from the ground; (5) does not include a hollow ground-penetrating housing; (6) includes a ground-penetrating spike that is integrated into the structure of the information display device; (7) is adapted to readily receive a separate and distinct card upon which identifying indicia or information can be written; (8) provides protection for the information-bearing card against rain; and (9) provides a holder for a writing implement so that a writing implement is readily available. The foregoing desired characteristics are provided by the unique ground-penetrating marker apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a ground-penetrating marker apparatus which includes a sign-supporting assembly which includes a receptacle portion adapted to receive an information-bearing card. A spike assembly is connected to a bottom portion of the sign-supporting assembly, and the spike assembly is adapted for penetration into a ground surface. A cover assembly is connected to a top portion of the sign-supporting assembly for protecting the receptacle portion of the sign-supporting assembly from rain. The sign-supporting assembly includes a floor portion, a back wall portion supported by the floor portion, a front wall portion supported by the floor portion, and two side wall portions is connected between the back wall portion and the front wall portion. The floor portion, the back wall portion, the front wall portion, and the side wall portions define the receptacle portion of the sign-supporting assembly.

The spike assembly is located medially between the two side wall portions of the sign-supporting assembly. The floor portion, the back wall portion, the front wall portion, and the side wall portions are in a form of a frame for receiving an information-bearing card. A holder assembly for a writing implement is connected to a rear portion of the sign-supporting assembly.

The bottom portion of the sign-supporting assembly includes a threaded well, and the spike assembly includes a threaded upper end adapted to be screwed into the threaded well of the sign-supporting assembly. The spike assembly also includes a lower pointed end adapted to penetrate the ground surface.

The sign-supporting assembly includes a first portion of a hinge assembly, and the cover assembly includes a second portion of a hinge assembly. The cover assembly includes an L-shaped cover member connected to the second portion of the hinge assembly. The L-shaped cover member includes a transparent panel portion which permits viewing an information-bearing card in position in the receptacle portion of the sign-supporting assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ground-penetrating marker apparatus which has all of the advantages of the prior art and none of the disadvantages.

It is another object of the present invention to provide a new and improved ground-penetrating marker apparatus which may be easily and efficiently manufactured and marketed.

It is a further object of the present invention to provide a new and improved ground-penetrating marker apparatus which is of durable and reliable construction.

An even further object of the present invention is to provide a new and improved ground-penetrating marker apparatus which is susceptible of a low cost of manufacture with regard to both materials and labor, and which accordingly is then susceptible of low prices of sale to the consuming public, thereby making such ground-penetrating marker apparatus available to the buying public.

Still yet a further object of the present invention is to provide a new and improved ground-penetrating marker apparatus which provides an information display device for marking a golf ball on a course which includes a ground-penetrating portion.

Still another object of the present invention is to provide a new and improved ground-penetrating marker apparatus that does not require making two holes in the ground each time the ground-penetrating marker apparatus is used.

Yet another object of the present invention is to provide a new and improved ground-penetrating marker apparatus which does not require a rocking motion for inserting or removing the apparatus from the ground.

Even another object of the present invention is to provide a new and improved ground-penetrating marker apparatus that permits use of a spinning motion to be employed with a ground-penetrating spike for inserting or removing the spike from the ground.

Still a further object of the present invention is to provide a new and improved ground-penetrating marker apparatus which does not include a hollow ground-penetrating housing.

Yet another object of the present invention is to provide a new and improved ground-penetrating marker apparatus that includes a ground-penetrating spike that is integrated into the structure of the information display device.

Still another object of the present invention is to provide a new and improved ground-penetrating marker apparatus which is adapted to readily receive a separate and distinct card upon which identifying indicia or information can be written.

Yet another object of the present invention is to provide a new and improved ground-penetrating marker apparatus that provides protection for the information-beating card against rain.

Still a further object of the present invention is to provide a new and improved ground-penetrating marker apparatus that provides a holder for a writing implement so that a writing implement is readily available.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a plurality of preferred embodiments of the ground-penetrating marker apparatus of the invention installed in a golf green.

FIG. 2 is an enlarged perspective view of one of the embodiments of the ground-penetrating marker apparatus shown in FIG. 1.

DESCRIPTION OF THE PREFERRED EMBODIMENT

Figure 3:
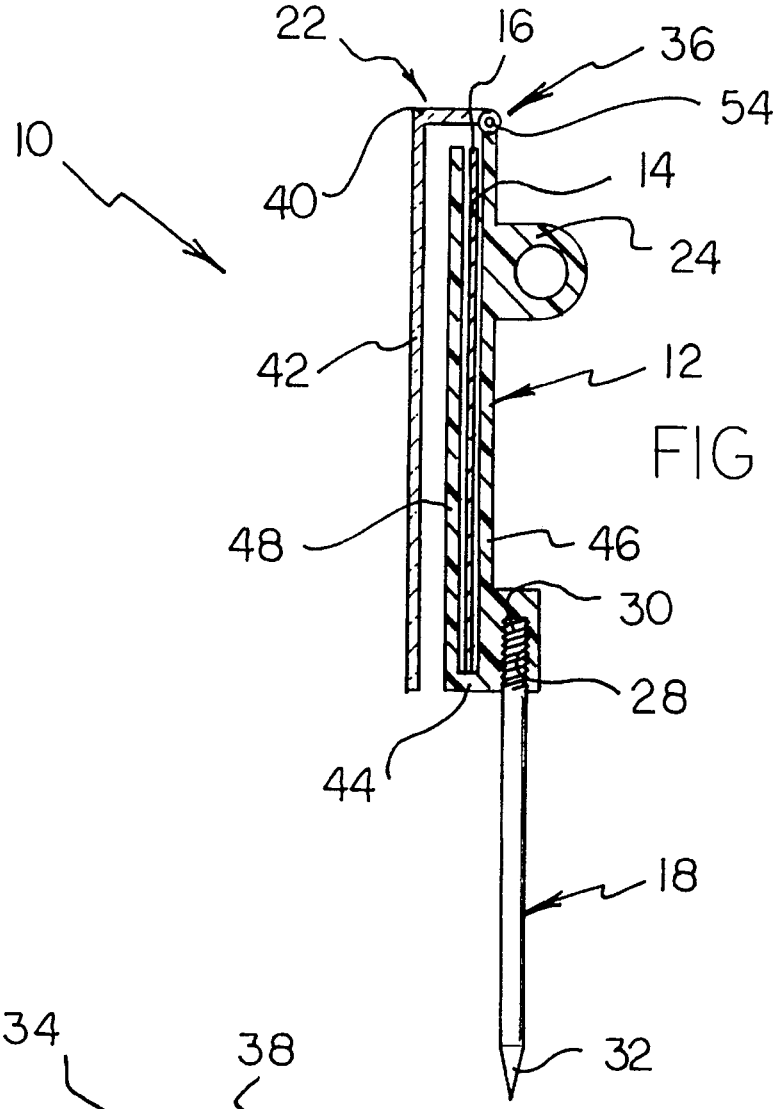
FIG. 3 is an enlarged cross-sectional view of the embodiment of the ground-penetrating marker apparatus of FIG. 2 taken along line 3—3 thereof.

With reference to the drawings, a new and improved ground-penetrating marker apparatus embodying the principles and concepts of the present invention will be described.

Turning to FIGS. 1–4, there is shown an exemplary embodiment of the ground-penetrating marker apparatus of the invention generally designated by reference numeral 10. In its preferred form, ground-penetrating marker apparatus 10 includes a sign-supporting assembly 12 which includes a receptacle portion 14 adapted to receive an information-bearing card 16. A spike assembly 18 is connected to a bottom portion of the sign-supporting assembly 12, and the spike assembly 18 is adapted for penetration into a ground surface 20. A cover assembly 22 is connected to a top portion of the sign-supporting assembly 12 for protecting the receptacle portion 14 of the sign-supporting assembly 12 from rain. The sign-supporting assembly 12 includes a floor portion 44, a back wall portion 46 supported by the floor portion 44, a front wall portion 48 supported by the floor portion 44, and two side wall portions 50 is connected between the back wall portion 46 and the front wall portion 48. The floor portion 44, the back wall portion 46, the front wall portion 48, and the side wall portions 50 define the receptacle portion 14 of the sign-supporting assembly 12.

The spike assembly 18 is located medially between the two side wall portions 50 of the sign-supporting assembly 12. The floor portion 44, the back wall portion 46, the front wall portion 48, and the side wall portions 50 are in a form of a frame for receiving an information-bearing card 16. A holder assembly 24 for a writing implement 26 is connected to a rear portion of the sign-supporting assembly 12.

The bottom portion of the sign-supporting assembly 12 includes a threaded well 28, and the spike assembly 18 includes a threaded upper end 30 adapted to be screwed into the threaded well 28 of the sign-supporting assembly 12. The spike assembly 18 also includes a lower pointed end 32 adapted to penetrate the ground surface 20.

The sign-supporting assembly 12 includes a first portion 34 of a hinge assembly 36, and the cover assembly 22 includes a second portion 38 of a hinge assembly 36. The cover assembly 22 includes an L-shaped cover member 40 connected to the second portion 38 of the hinge assembly 36. The L-shaped cover member 40 includes a transparent panel portion 42 which permits viewing an information-bearing card 16 in position in the receptacle portion 14 of the sign-supporting assembly 12.

Figure 4:
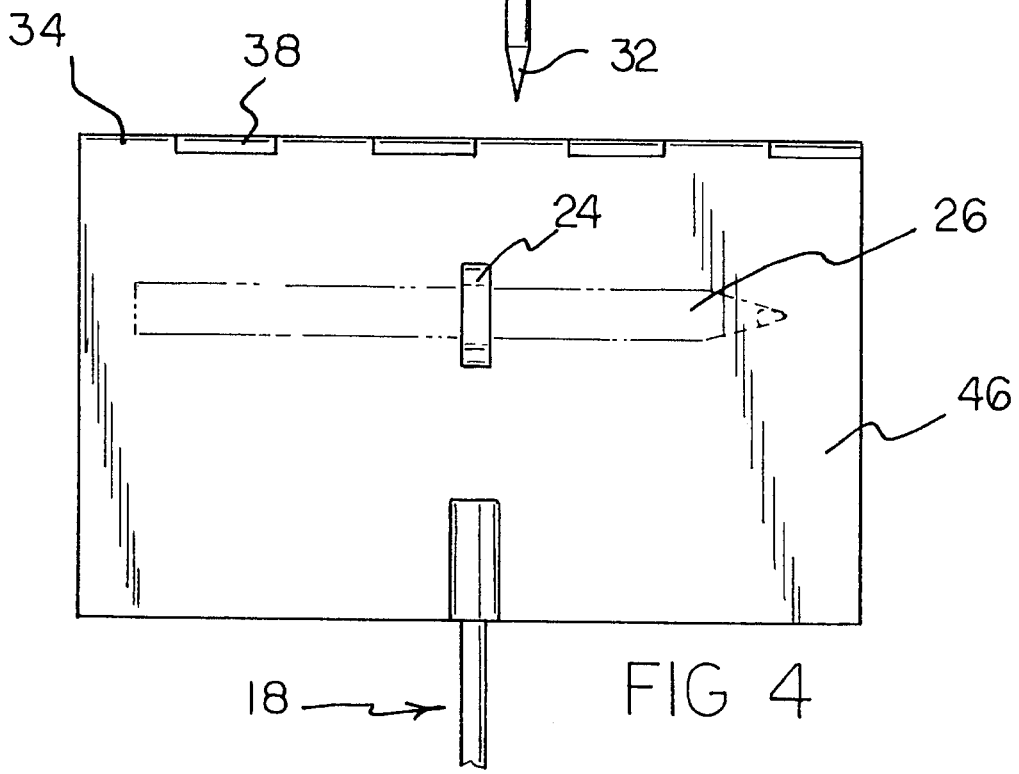
FIG. 4 is an enlarged rear view of the embodiment of the invention shown in FIG. 2 taken along line 4—4 thereof.

In use, some information is written on the information-bearing card 16 using a writing implement such as the writing implement 26 shown in FIG. 4. The transparent panel portion 42 of the cover assembly 22 is lifted up and around the hinge assembly 36, and the information-beating card 16 is inserted into the frame-like receptacle portion 14 of the sign-supporting assembly 12. The transparent panel portion 42 of the cover assembly 22 is then lowered so that the L-shaped cover member 40 of the cover assembly 22 covers the receptacle portion 14 and the information-beating card 16 contained therein. The ground-penetrating marker apparatus 10 of the invention is grasped in a person's hand, the lower pointed end 32 of the spike assembly 18 is pushed into the ground surface 20. As the spike assembly 18 is pushed into the ground surface, the sign-supporting assembly 12 can be rotated back and forth or spun around the spike assembly 18 to aid in penetration into the ground surface 20.

The ground-penetrating marker apparatus 10 of the invention is removed from the ground surface 20 when the player in a golf game is to move on to the next hole. A rotational back and forth or spinning motion around the spike assembly 18 can be used to remove the ground-penetrating marker apparatus 10 of the invention from the ground.

The writing implement 26 can be removed from the holder assembly 24 in order to write on the information-bearing card 16. When writing is done, the writing implement 26 can be placed back in the holder assembly 24.

When the L-shaped cover member 40 is lowered over the front wall portion 48 of the sign-supporting assembly 12, the transparent panel portion 42 permits easy viewing of the information-bearing card 16 while, at the same time, protecting the information-bearing card 16 from rain that may fall. A hinge pin 54 may be present as part of the first portion 34 of the hinge assembly 36 to connect the first portion 34 of the hinge assembly 36 to the second portion 38 of the hinge assembly 36.

In an alternative embodiment of the invention, the hinge assembly 36 can avoided, and a single, unitary, plastic, molded structure can be provided which includes the cover assembly 22 and the sign-supporting assembly 12. In such an embodiment, one of the two side wall portions 50 would be removed to allow access to the receptacle portion 14 for insertion and removal of the information-bearing card 16.

The components of the ground-penetrating marker apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved ground-penetrating marker apparatus that is low in cost, relatively simple in design and operation, and which may advantageously be used to provide an information display device for marking a golf ball on a course which includes a ground-penetrating portion. With the invention, a ground-penetrating marker apparatus is provided which does not require making two holes in the ground each time the ground-penetrating marker apparatus is used. With the invention, a ground-penetrating marker apparatus is provided which does not require a rocking motion for inserting or removing the apparatus from the ground. With the invention, a ground-penetrating marker apparatus is provided which permits use of a spinning motion to be employed with a ground-penetrating spike for inserting or removing the spike from the ground. With the invention, a ground-penetrating marker apparatus is provided which does not include a hollow ground-penetrating housing. With the invention, a ground-penetrating marker apparatus is provided which includes a ground-penetrating spike that is integrated into the structure of the information display device. With the invention, a ground-penetrating marker apparatus is provided which is adapted to readily receive a separate and distinct card upon which identifying indicia or information can be written. With the invention, a ground-penetrating marker apparatus provides protection for the information-beating card against rain. With the invention, a ground-penetrating marker apparatus provides a holder for a writing implement so that a writing implement is readily available.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A ground-penetrating marker apparatus, comprising:

a sign-supporting assembly which includes a receptacle portion adapted to receive an information-bearing card, a spike assembly connected to a bottom portion of said sign-supporting assembly, said spike assembly adapted for penetration into a ground surface, and a cover assembly, connected to a top portion of said sign-supporting assembly, for weather protecting said receptacle portion of said sign-supporting assembly, wherein said sign-supporting assembly includes a top edge, an opposed bottom edge, and first and second opposed side edges extending between said top edge and said bottom edge, said cover assembly further including a first portion of a hinge assembly connected to said top edge, wherein said cover assembly includes an L-shaped cover member oriented with its short side at the top thereof and with its long side extending orthogonally and downwardly with respect to said short side, said short side of said L-shaped cover member being connected to said second portion of said hinge assembly, wherein said receptacle portion comprises a frame member extending along said opposed first and second sides and along said bottom edge of said sign-supporting assembly, wherein said long side of said L-shaped cover member terminates in a bottom edge portion at least partially coextensive with the said frame member extending along said bottom edge of said receptacle portion and includes a transparent panel portion which extends co-extensively with at least a portion of said sign, supporting assembly to permit viewing an information-bearing card maintained in position in said receptacle portion of said sign-supporting assembly by said frame member, wherein said bottom portion of said sign-supporting assembly includes a well extending rearwardly and oppositely with respect to said frame member bottom edge and said L-shaped cover member bottom edge portion at least partially co-extensive therewith, and wherein said spike assembly includes an upper end adapted to be engaged within said well of said sign-supporting assembly and includes a lower pointed end adapted to penetrate the ground surface.

2. The apparatus of claim 1, further including:

a holder assembly for a writing implement connected to a rear portion of said sign-supporting assembly.

* * * * *